United States Patent [19]

Fillmore et al.

[11] Patent Number: 4,940,167

[45] Date of Patent: Jul. 10, 1990

[54] CHILD RESISTANT DISPENSING CLOSURE

[75] Inventors: William E. Fillmore, Toledo; Timothy J. Fuchs, Perrysburg, both of Ohio

[73] Assignee: Owens-Illinois Closure Inc., Toledo, Ohio

[21] Appl. No.: 302,850

[22] Filed: Jan. 27, 1989

[51] Int. Cl.[5] ..... B67B 5/00

[52] U.S. Cl. ..... 222/153; 222/562; 215/216; 215/237

[58] Field of Search ..... 222/153, 542, 556, 562, 222/546, 554, 548, 594, 498; 215/216, 237

[56] References Cited

U.S. PATENT DOCUMENTS

| | | | |
|---|---|---|---|
| 4,209,100 | 6/1980 | Uhlig | 222/153 |
| 4,711,363 | 12/1987 | Marino | 222/153 |
| 4,782,964 | 11/1988 | Poore et al. | 222/153 |

*Primary Examiner*—Michael S. Huppert
*Assistant Examiner*—Kenneth Noland

[57] ABSTRACT

A child resistant dispensing closure comprising a first part having a base wall and a peripheral skirt adapted to be threaded onto a container. The peripheral skirt includes interengaging portions that engage portions of the container to prevent removal from the container. The closure also includes a second part or lid connected to the first part by an integral hinge and having a base wall, peripheral skirt and a closing portion adapted to extend into a nozzle on the base wall of the first part when the second part is moved into overlying relationship to the first part. Snap lugs on the second part engage bead segments on the firt part to hold the second part in closed position. The diameter of the skirt of the first part includes a radial flange that extends circumferentially about most of the periphery of the skirt. The flange is connected integrally to an outer radially deflectable wall panel. The skirt of the second part is smaller than the diameter of the flange so that the flange projects radially beyond the lid skirt and the lid skirt cannot be raised readily. A shoulder projects axially from the flange to center the lid and support the skirt against radial deflection. By pressing the deflectable wall panel radially inwardly the panel engages an axial rib on the skirt of the lid camming the skirt of the lid upwardly and exposing it so that it may be opened.

2 Claims, 3 Drawing Sheets

CHILD RESISTANT DISPENSING CLOSURE

This invention relates to hinged dispensing closures and particularly to child resistant hinged dispensing closures.

BACKGROUND AND SUMMARY OF THE INVENTION

One type of closure that is commonly used is of the hinged dispensing closure type comprising a first part which is interengaged with the container and a second part connected to the first part by integral hinge and adapted to close against the first part to cover a dispensing opening. It has heretofore been difficult to provide a child resistant closures of this type. One type that has heretofore been suggested utilizes a double skirt which has the disadvantage of being easily filled with dirt or the product being dispensed.

Among the objectives of the present invention are to provide a child resistant hinged dispensing closure which utilizes a single flange skirt and effectively resists efforts of a child to remove and lift the lid; which can be readily manufactured; and which is pleasing in appearance.

In accordance with the invention, the child resistant dispensing closure comprises a first part having a base wall and a peripheral skirt adapted to be threaded onto a container. The peripheral skirt includes interengaging portions that engage portions of the container to prevent removal from the container. The closure also includes a second part connected to the first part by a integral hinge and having a base wall, peripheral skirt and a closing portion adapted to extend into a nozzle on the base wall of the first part when the second that is moved into overlying relationship to the first part. Snap lugs on the second part engage bead segments on the first part to hold the second part in closed position. The diameter of the skirt of the first part includes a radial flange that extends circumferentially about most of the periphery of the skirt. The flange is connected integrally to an outer radially deflectable wall panel. The diameter of the skirt of the second part is smaller than the diameter of the flange so that the flange projects radially beyond the lid skirt and the lid skirt cannot be raised readily. A shoulder projects upwardly from the flange to center the lid and support the skirt against radial deflection. By pressing the deflectable wall panel radially inwardly the panel engages an axial rib on the skirt of the lid camming the skirt of the lid upwardly and exposing it so that it may be opened.

DESCRIPTION

Figure 1:
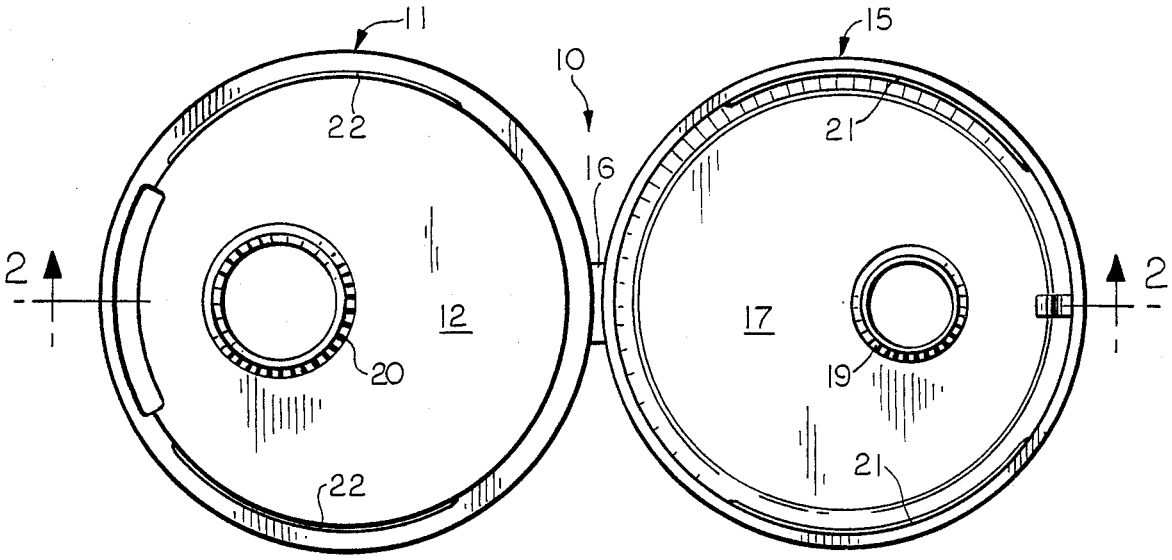
FIG. 1 is a plan view of the closure embodying the invention.
Figure 2:
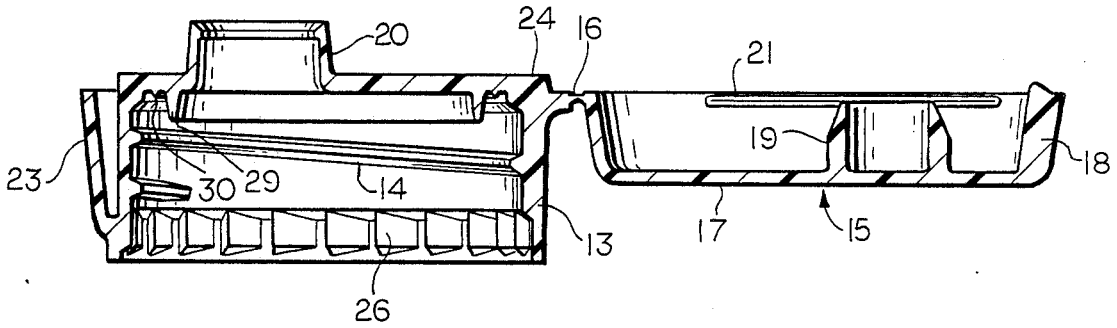
FIG. 2 is a sectional view taken along the line 2—2 in FIG. 1.
Figure 3:
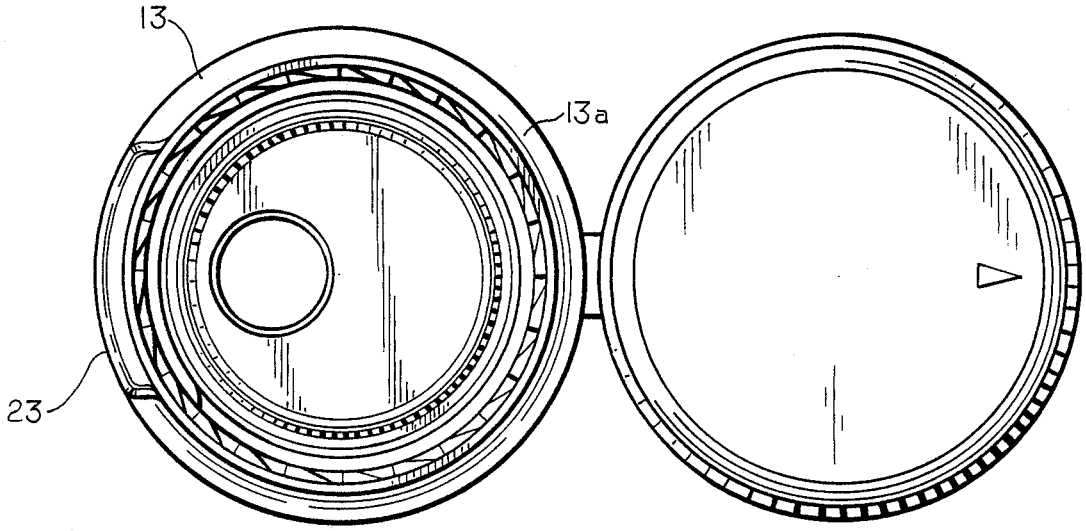
FIG. 3 is a bottom plan view of the closure shown in FIG. 1.
Figure 4:
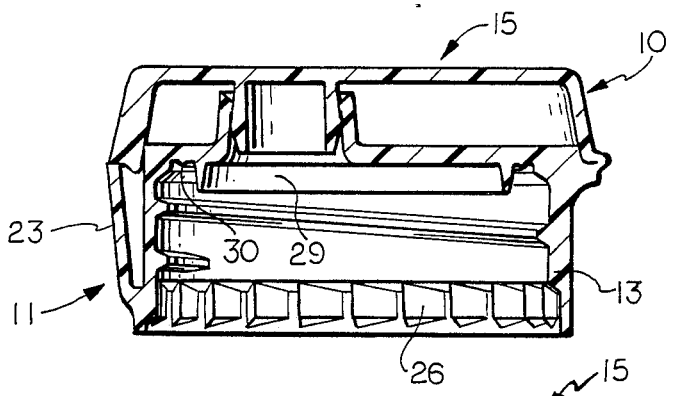
FIG. 4 is a sectional view similar to FIG. 2 showing the closure in closed position.

Referring to FIGS. 1–4 the child resistant dispensing plastic closure 10 embodying the invention, comprises a first part having a base wall 11 and a peripheral skirt 13. The peripheral skirt 13 includes interengaging portions in the form of threads 14 engage complementary threads of the container C (FIG. 5) to secure the child resistant dispensing closure to the container C. The closure 10 also includes a second part or lid 15 connected to the first part by a integral hinge 16. Part 15 has a base wall 17, peripheral skirt 18 and a tubular closing portion 19 adapted to extend into a nozzle 20 on the base wall of the first part when the second part 15 is moved into overlying relationship to the first part 11.

Arcuate snap lugs 21 on the second part 15 engage bead segments 22 on the first part 11 to hold the second part 15 in closed position. The skirt 13 of the first part 11 includes a radial flange **13*a* that extends circumferentially about most of the periphery of the skirt 13. The flange is connected integrally to a radially deflectable wall panel 23. The deflectable wall panel 23 is positioned diametrically opposite the hinge 16 and has an arcuate extent that defines an acute angle on the order of 60°. The diameter of the skirt 18 of the second part 15 is smaller than the diameter of the flange 13*a* so that the flange 13*a* projects beyond the lid skirt 18 and the lid skirt 18** cannot be raised readily.

A flange or shoulder 24 on skirt 13 projects axially from the flange **13*a* to center the lid 18** and support the skirt against radial deflection.

The skirt 13 further includes a plurality of circumferentially spaced assymetrical teeth 26 which are adapted to engage serrations 27 on the neck 28 of the container C to prevent removal of the closure from the container when it is applied.

Figure 5:
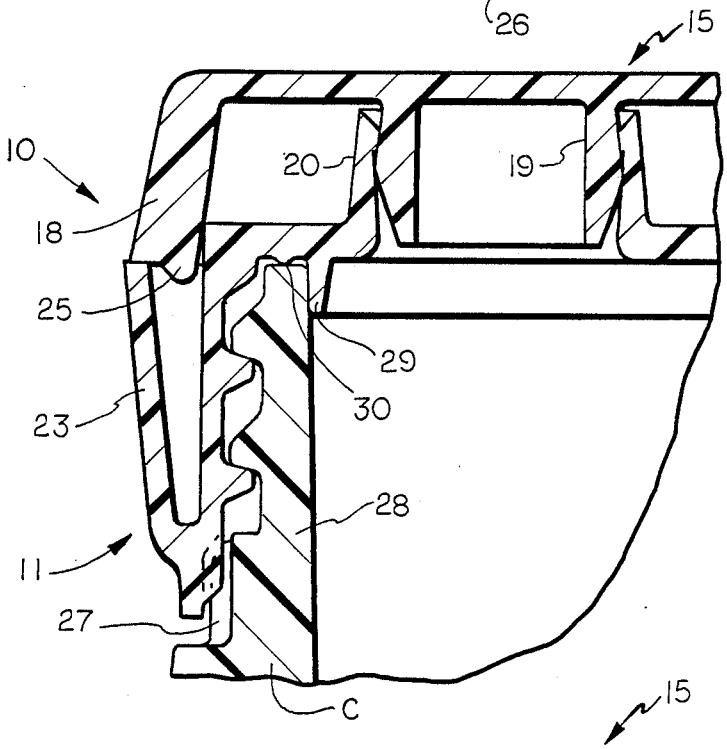
FIG. 5 is a fragmentary sectional view of the closure shown in FIG. 4 on an enlarged scale.
Figure 6:
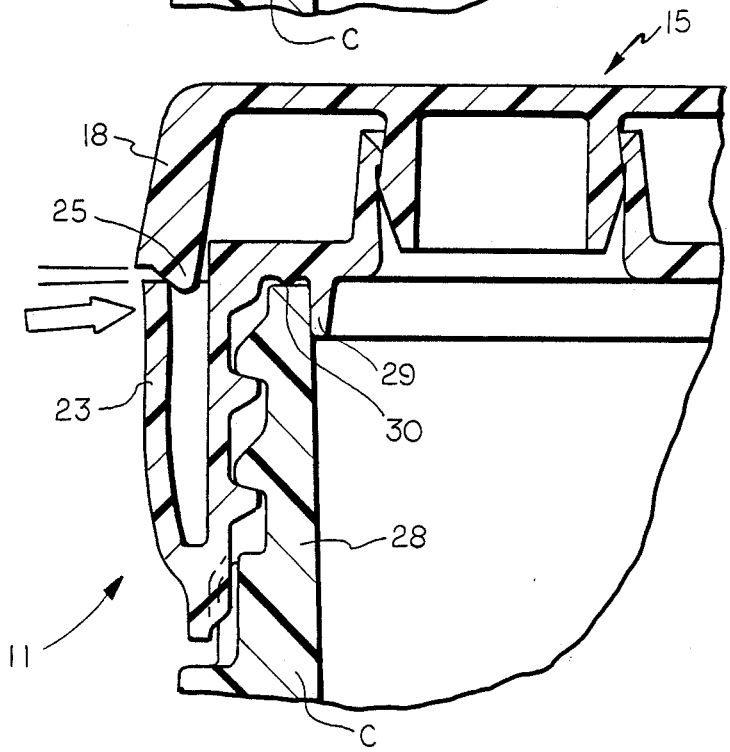
FIG. 6 is a fragmentary sectional view similar to FIG. showing the opening of the closure.

As shown in FIG. 5, when the closure is applied to the container and the lid 15 is in closed position relative to the part 11, the closing portion 19 is engaged with the nozzle 20, sealing the nozzle. A seal is provided between the first part 11 and the finish 28 by an annular plug portion 29 engaging the inner surface of the neck and an annular bead 30 engaging the upper surface of the neck.

Figure 7:
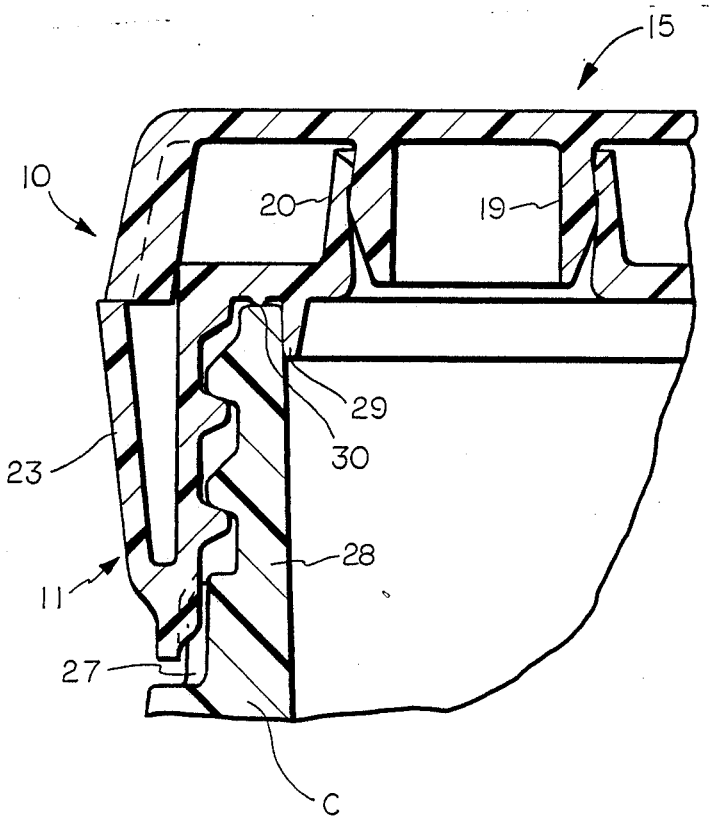
FIG. 7 is a fragmentary sectional view of a modified form of closure.

In the form or closure set forth in FIG. 7, the rib 25 is eliminated. By pressing the deflectable wall panel 23 radially inwardly the panel 23 engages an axial rib 25 on the skirt 18 on the lid 15 camming the skirt 18 of the lid 15 upwardly and exposing it so that it may be opened.

The closure may be made of plastic such as polypropylene.

It can thus be seen that there has been provided a child resistant hinged dispensing closure which utilizes a single flange skirt and effectively resist efforts of a child to remove and lift the lid, which can be readily manufactured, and which is pleasing in appearance.

We claim:

1. A child resistant dispensing closure comprising a first plastic part having a base wall and a peripheral skirt threaded onto a container, said skirt of said first part including a radial flange, said peripheral skirt including interengaging portions that engage portions of a container to resist removal from the container, said closure including a second plastic part connected to the first part by an integral hinge, said second part including a base wall and a peripheral skirt, said base wall of said skirt having a dispensing opening, said skirt of said second part having diameter smaller than the diameter of the flange so that the flange projects radially beyond the skirt of said second part and the skirt of said second part cannot be raised readily when the second part is in closed position with the skirt of said second part engaging said flange on the first part, said skirt of said first part including a radial flange that extends circumferentially about most of the periphery of said skirt, said first part having a deflectable wall panel spaced radially outwardly of said skirt and extending upwardly and axially outwardly and integrally joined to said skirt of said first part adjacent said free edge and along circumferentially spaced axis of said skirt, said radially deflectable wall panel having an upper free edge at least a portion of which underlies the free edge of said skirt of said second part when the second part is in closed position, said flange extending along said radially deflectable wall, said skirt of the second part having an axial rib extending between the deflectable wall panel on the first part and the skirt of the first part such that when the deflectable panel is pressed radially inwardly, the panel engages the rib camming the skirt of the second part upwardly and exposing it so that it may be opened, said base wall of said first part including a shoulder projecting axially for engaging and centering the second part and supporting the skirt of said second part against radial deflection.

2. The child resistant dispensing closure set forth in claim 1 including interengaging snap lugs between said first part and second part to hold the second part in closed position.

* * * * *